US008579051B2

(12) United States Patent
Buske et al.

(10) Patent No.: US 8,579,051 B2
(45) Date of Patent: Nov. 12, 2013

(54) ANTI-TRACKING SPEAR POINTS FOR EARTH-BORING DRILL BITS

(75) Inventors: Robert J. Buske, The Woodlands, TX (US); James Florey, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 318 days.

(21) Appl. No.: 12/852,165

(22) Filed: Aug. 6, 2010

(65) Prior Publication Data

US 2011/0031021 A1 Feb. 10, 2011

Related U.S. Application Data

(60) Provisional application No. 61/232,133, filed on Aug. 7, 2009.

(51) Int. Cl.
*E21B 10/16* (2006.01)

(52) U.S. Cl.
USPC ..... 175/376; 175/341; 175/378

(58) Field of Classification Search
USPC ..... 175/341, 376, 377, 378
See application file for complete search history.

(56) References Cited

U.S. PATENT DOCUMENTS

| | | | | |
|---|---|---|---|---|
| 2,533,258 A | | 12/1950 | Morlan et atl. | |
| 2,533,259 A | * | 12/1950 | Woods et al. | 175/341 |
| 3,126,067 A | * | 3/1964 | Schumacher | 175/374 |
| 4,716,977 A | | 1/1988 | Huffstutler | |
| 4,726,432 A | | 2/1988 | Scott et al. | |
| 4,727,942 A | | 3/1988 | Galle et al. | |
| 5,197,555 A | | 3/1993 | Estes | |
| 5,311,958 A | | 5/1994 | Isbell et al. | |
| 5,839,526 A | | 11/1998 | Cisneros et al. | |
| 6,253,862 B1 | | 7/2001 | Overstreet et al. | |
| 6,401,839 B1 | | 6/2002 | Chen | |

(Continued)

FOREIGN PATENT DOCUMENTS

| | | |
|---|---|---|
| WO | 0003114 | 1/2000 |
| WO | 2007146168 | 12/2007 |

OTHER PUBLICATIONS

Bourne, H.A.; Reichmuth, D.R.; and Haden, E.L., "Circumferential-Toothed Rock Bits—A Laboratory Evaluation of Penetration Performance", Journal of Petroleum Technology, vol. 19 (No. 1), pp. 113-119 (Jan. 1967).

(Continued)

*Primary Examiner* — Giovanna Wright
(74) *Attorney, Agent, or Firm* — Sutton McAughan Deaver, PLLC

(57) ABSTRACT

Described herein are roller cone drill bits and modified roller cones for use in drilling subterranean earth formations, and more specifically roller cone drill bits and roller cones having optimized spear point designs and blade orientations on at least one of the roller cones for reduced tracking and/or increased drilling performance during bit use. The roller cone drill bits include a bit body with a longitudinal axis, one or more bit legs depending from the body, and at least one roller cone attached to each of the bit legs and able to rotate with respect to the bit body, wherein at least one of the roller cones includes a spear point at the cone apex having two or more cutting blades, the cutting blades being oriented at a variety of non-equal, asymmetric angles about a central cone axis with respect to each other, such that tracking during drilling using the drill bit is minimized or eliminated.

12 Claims, 8 Drawing Sheets

(56) References Cited

U.S. PATENT DOCUMENTS

| | | | | |
|---|---|---|---|---|
| 6,527,068 | B1 | 3/2003 | Singh et al. | |
| 6,637,527 | B1 | 10/2003 | Singh et al. | |
| 6,827,161 | B2 | 12/2004 | Singh et al. | |
| 6,923,276 | B2 | 8/2005 | Overstreet et al. | |
| 6,942,045 | B2 | 9/2005 | Dennis | |
| 7,234,549 | B2 | 6/2007 | McDonough et al. | |
| 7,292,967 | B2 | 11/2007 | McDonough et al. | |
| 7,343,990 | B2 | 3/2008 | Pessier et al. | |
| 2003/0183425 | A1 | 10/2003 | Liang et al. | |
| 2006/0027401 | A1* | 2/2006 | Nguyen | 175/341 |
| 2006/0118333 | A1 | 6/2006 | Chen | |
| 2007/0227781 | A1 | 10/2007 | Cepeda et al. | |
| 2008/0179102 | A1 | 7/2008 | Gatell et al. | |

OTHER PUBLICATIONS

Strommen, H., International Search Report for International Patent Application No. PCT/US2010/044754, European Patent Office, dated Mar. 31, 2011.

Strommen, H., Written Opinion for International Patent Application No. PCT/US2010/044754, European Patent Office, dated Mar. 31, 2011.

* cited by examiner

| Milled Tooth Bits | | |
|---|---|---|
| Series | Formation | Types |
| 1 | Soft Formations/Low-Compressive Strength | 1<br>2<br>3 |
| 2 | Medium to Medium-Hard Formations/Compressive Strength | 1<br>2<br>3 |
| 3 | Hard, Semi-Abrasive Formations | 1<br>2<br>3 |
| TCI Bits | | |
| Series | Formation | Types |
| 4 | Soft Formations/Low-Compressive Strength | 1<br>2<br>3<br>4 |
| 5 | Soft to Medium-Hard Formations/Low-Compressive Strength | 1<br>2<br>3<br>4 |
| 6 | Medium-Hard Formations/High-Compressive Strength | 1<br>2<br>3<br>4 |
| 7 | Hard, Semi-Abrasive and Abrasive Formations | 1<br>2<br>3<br>4 |
| 8 | Extremely Hard and Abrasive Formations | 1<br>2<br>3<br>4 |

FIG. 7

ANTI-TRACKING SPEAR POINTS FOR EARTH-BORING DRILL BITS

CROSS REFERENCE TO RELATED APPLICATIONS

The present application claims priority to U.S. Provisional Patent Application Ser. No. 61/232,133 filed Aug. 7, 2009, the contents of which are incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to roller cone drill bits for use in drilling subterranean earth formations, and more specifically relate to roller cone drill bits having optimized spear point designs and blade orientations for reduced tracking and/or increased drilling performance during bit use.

2. Description of the Related Art

Roller cone rock bits are commonly used in the oil and gas industry for drilling wells. A roller cone drill bit typically includes a bit body with a threaded connection at one end for connecting to a drill string and a plurality of roller cones, typically three, attached at the opposite end and able to rotate with respect to the bit body. Disposed on each of the cones are a number of cutting elements, typically arranged in rows about the surface of the individual cones. The cutting elements may typically comprise tungsten carbide inserts, polycrystalline diamond compacts, milled steel teeth, or combinations thereof.

Significant expense is involved in the design and manufacture of drill bits to produce drill bits with increased drilling efficiency and longevity. Roller cone bits can be considered to be more complex in design than fixed cutter bits, in that the cutting surfaces of the bit are disposed on roller cones. Each of the roller cones rotates independently relative to the rotation of the bit body about an axis oblique to the axis of the bit body. Because the roller cones rotate independent of each other, the rotational speed of each cone is typically different. For a given cone, the cone rotation speed generally can be determined from the rotational speed of the bit and the effective radius of the "drive row" of the cone. The effective radius of a cone is generally related to the radial extent of the cutting elements on the cone that extend axially the farthest, with respect to the bit axis, toward the bottomhole. These cutting elements typically carry higher loads and may be considered as generally located on a so-called "drive row". The cutting elements located on the cone to drill the full diameter of the bit are referred to as the "gage row".

Adding to the complexity of roller cone bit designs, cutting elements disposed on the cones of the roller cone bit deform the earth formation by a combination of compressive fracturing and shearing forces. Additionally, most modern roller cone bit designs have cutting elements arranged on each cone so that cutting elements on adjacent cones intermesh between the adjacent cones. The intermeshing cutting elements on roller cone drill bits is typically desired to minimize bit balling between adjacent concentric rows of cutting elements on a cone and/or to permit higher insert protrusion to achieve competitive rates of penetration ("ROP") while preserving the longevity of the bit. However, intermeshing cutting elements on roller cone bits substantially constrains cutting element layout on the bit, thereby, further complicating the designing of roller cone drill bits.

One prominent and recurring problem with many current roller cone drill bit designs is that the resulting cone arrangements, whether arrived at arbitrarily or using simulated design parameters, may provide less than optimal drilling performance due to problems which may not be readily detected, such as "tracking" and "slipping." Tracking occurs when cutting elements on a drill bit fall into previous impressions formed by other cutting elements at preceding moments in time during revolution of the drill bit. This overlapping will put lateral pressure on the teeth, tending to cause the cone to align with the previous impressions. Tracking can also happen when teeth of one cone's heel row fall into the impressions made by the teeth of another cone's heel row. Slipping is related to tracking and occurs when cutting elements strike a portion of the previously made impressions and then slide into these previous impressions rather than cutting into the uncut formation.

Cutting elements on the cones do not cut effectively when they fall or slide into previous impressions made by other cutting elements. In particular, tracking is inefficient because no fresh rock is cut. It is additionally undesirable because tracking results in slow rates of penetration (ROP), detrimental wear of the cutting structures, and premature failure of the bits themselves. Slipping is also undesirable because it can result in uneven wear on the cutting elements themselves, which in turn can result in premature cutting element failure. Thus, tracking and slipping during drilling can lead to low penetration rates and in many cases uneven wear on the cutting elements and cone shell. By making proper adjustments to the arrangement of cutting elements on a bit, problems such as tracking and slipping can be significantly reduced. This is especially true for cutting elements on a drive row of a cone because the drive row generally governs the rotation speed of the cone.

Previous approaches exist for varying the orientation of cutting elements on a bit to address these tracking concerns and problems. For example, U.S. Pat. No. 6,401,839, issued to Chen, discloses varying the orientation of the crests of chisel-type cutting elements within a row, or between overlapping rows of different cones, to reduce tracking problems and improve drilling performance. U.S. Pat. Nos. 6,527,068 and 6,827,161, both issued to Singh, disclose specific methods for designing bits by simulating drilling with a bit to determine its drilling performance and then adjusting the orientation of at least one non-axisymmetric cutting element on the bit and repeating the simulating and determining until a performance parameter is determined to be at an optimum value. U.S. Pat. No. 6,942,045, issued to Dennis, discloses a method of using cutting elements with different geometries on a row of a bit to cut the same track of formation and help reduce tracking problems. However, in many drilling applications, such as the drilling of harder formations, the use of asymmetric cutting elements such as chisel-type cutting elements are not desired due to their poorer performance in these geological applications.

Prior approaches also exist for using different pitch patterns on a given row to address the tracking concerns. For example, U.S. Pat. No. 7,234,549 and U.S. Pat. No. 7,292,967 describe methods for evaluating a cutting arrangement for a drill bit that specifically includes selecting a cutting element arrangement for the drill bit and calculating a score for the cutting arrangement. This method may then be used to evaluate the cutting efficiency of various drill bit designs. In one example, this method is used to calculate a score for an arrangement based on a comparison of an expected bottom hole pattern for the arrangement with a preferred bottom hole pattern. The use of this method has reportedly lead to roller cone drill bit designs that exhibit reduced tracking over previous drill bits.

While the above approaches are considered useful in particular specific applications, typically directed to address drilling problems in a particular geologic formation, in other applications the use of such varied cutting elements is undesirable, and the use of different pitch patterns can be difficult to implement, resulting in a more complex approach to drill bit design and manufacture than necessary for addressing tracking concerns. What is desired is a simplified design approach that results in reduced tracking for particular applications without sacrificing bit life or requiring increased time or cost associated with design and manufacturing.

One method commonly used to discourage bit tracking is known as a staggered tooth design. In this design the teeth are located at unequal intervals along the circumference of the cone. This is intended to interrupt the recurrent pattern of impressions on the bottom of the hole. However, staggered tooth designs do not prevent tracking of the outermost rows of teeth, where the teeth are encountering impressions in the formation left by teeth on other cones. Staggered tooth designs also have the short-coming that they can cause fluctuations in cone rotational speed and increased bit vibration. For example, U.S. Pat. No. 5,197,555 to Estes discloses rotary cone cutters for rock drill bits using milled-tooth cones and having circumferential rows of wear resistant inserts. As specifically recited therein, "inserts on the two outermost rows are oriented at an angle in relationship to the axis of the cone to either the leading side or trailing side of the cone. Such orientation will achieve either increased resistance to insert breakage and/or increased rate of penetration."

The inventions disclosed and taught herein are directed to new roller cone drill bit and cone designs, as well as methods and systems and drilling methods using these designs, in which variation in the roller cone spearpoint blade angle is used to reduce bit tracking.

BRIEF SUMMARY OF THE INVENTION

Described herein are drill bits, rotatable elements for drill bits, and systems using such drill bits which minimize or reduce bit tracking during drilling operations, wherein the bits include at least one rotatable element which includes a spearpoint at the apex of the rotatable element, central to the central axis of rotation of the element, wherein the spearpoint includes two or more cutting blades or teeth arranged asymmetrically around the central axis of the spearpoint.

In accordance with a first aspect of the present disclosure, an earth-boring drill bit is described, the bit comprising a body with a longitudinal axis; a plurality of bit legs depending from the body; and a plurality of roller cones attached to each of the bit legs and able to rotate with respect to the bit body, each of the cones having a plurality of rows of teeth formed thereon such that each tooth is separated from an adjacent tooth by a valley and each row is separated from an adjacent row by an annular band; wherein one of the roller cones comprises a spear point with two or more cutting teeth, the cutting teeth being oriented at an asymmetric angle about a central axis of the cone relative to each other. In accordance with this aspect of the disclosure, the arrangement of cutting teeth on the spearpoint reduces the likelihood of bit tracking during drilling operations. In accordance with aspects of this embodiment, the plurality of roller cones comprise three roller cones. In further aspects, the drill bit comprises a layer of hardfacing on the teeth of the roller cones.

In accordance with further aspects of the present disclosure, a roller cone drill bit is described, the bit comprising a plurality of non-axially-symmetric teeth mounted on rotatable elements, one of the rotatable elements comprising a spearpoint at its apex having a plurality of cutting teeth arranged about the central axis of rotation of the rotatable element and of the spearpoint, wherein ones of the cutting teeth which follow the same path on a cutting face have different axial orientations; wherein a first plurality of the cutting teeth are contiguous and all have a first orientation, and a second plurality of the cutting teeth are contiguous and all have a second orientation, the first and second orientations being asymmetric about the central axis of rotation of the rotatable element; and whereby the likelihood of bit tracking is reduced.

In accordance with yet another aspect of the present disclosure, a bit for downhole rotary drilling is described, the bit comprising a plurality of roller cones, each cone being rotatably mounted on a bit body; a plurality of cutting elements on each of the cones; and a spearpoint at the apex of one of the cones comprising a plurality of cutting elements surrounding a central axis of rotation of the cone and the spearpoint; wherein at least one of the cutting elements on the spearpoint being non-symmetrically oriented with respect to at least one other cutting element; and wherein an angle between at least two of the non-symmetrically oriented cutting elements on the spearpoint, relative to the axis of rotation of the cone on which the spearpoint is disposed is selected to reduce the bit tracking drilling performance parameter.

In accordance with further aspects of the present disclosure, a rotary drilling system for use in drilling a subterranean formation is described, the system comprising a drill string which is connected to a drill bit, and a rotary drive which rotates at least part of the drill string together with the bit. In further accordance with this aspect of the disclosure, the bit comprises a plurality of rotatable elements mounted to roll along a cutting face when the drill bit is rotated under load, each of the rotatable element having teeth thereon; and a spearpoint at the apex of one of the rotatable elements comprising a plurality of cutting elements surrounding a central axis of rotation of the rotatable element and the spearpoint; wherein at least one of the cutting elements on the spearpoint is non-symmetrically oriented with respect to at least one other cutting element; and wherein an angle between at least two of the non-symmetrically oriented cutting elements on the spearpoint, relative to the axis of rotation of the rotatable element on which the spearpoint is disposed. This non-symmetric orientation of cutting elements on the spearpoint of a rotatable element of the drill bit allows for a reduction in bit tracking during drilling operations.

In yet another aspect of the present disclosure, a rotatable cone for use with a roller cone drill bit is described, the cone comprising a plurality of cutting elements arranged on the exterior of the cone; and a spearpoint at the apex of the cone, the spearpoint comprising a plurality of cutting elements surrounding a central axis of rotation of the cone and the spearpoint; wherein at least one of the cutting elements on the spearpoint being non-symmetrically oriented with respect to at least one other cutting element on the spearpoint.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

FIG. 7 illustrates a partial view of an exemplary IADC bit classification chart.

Figure 1:
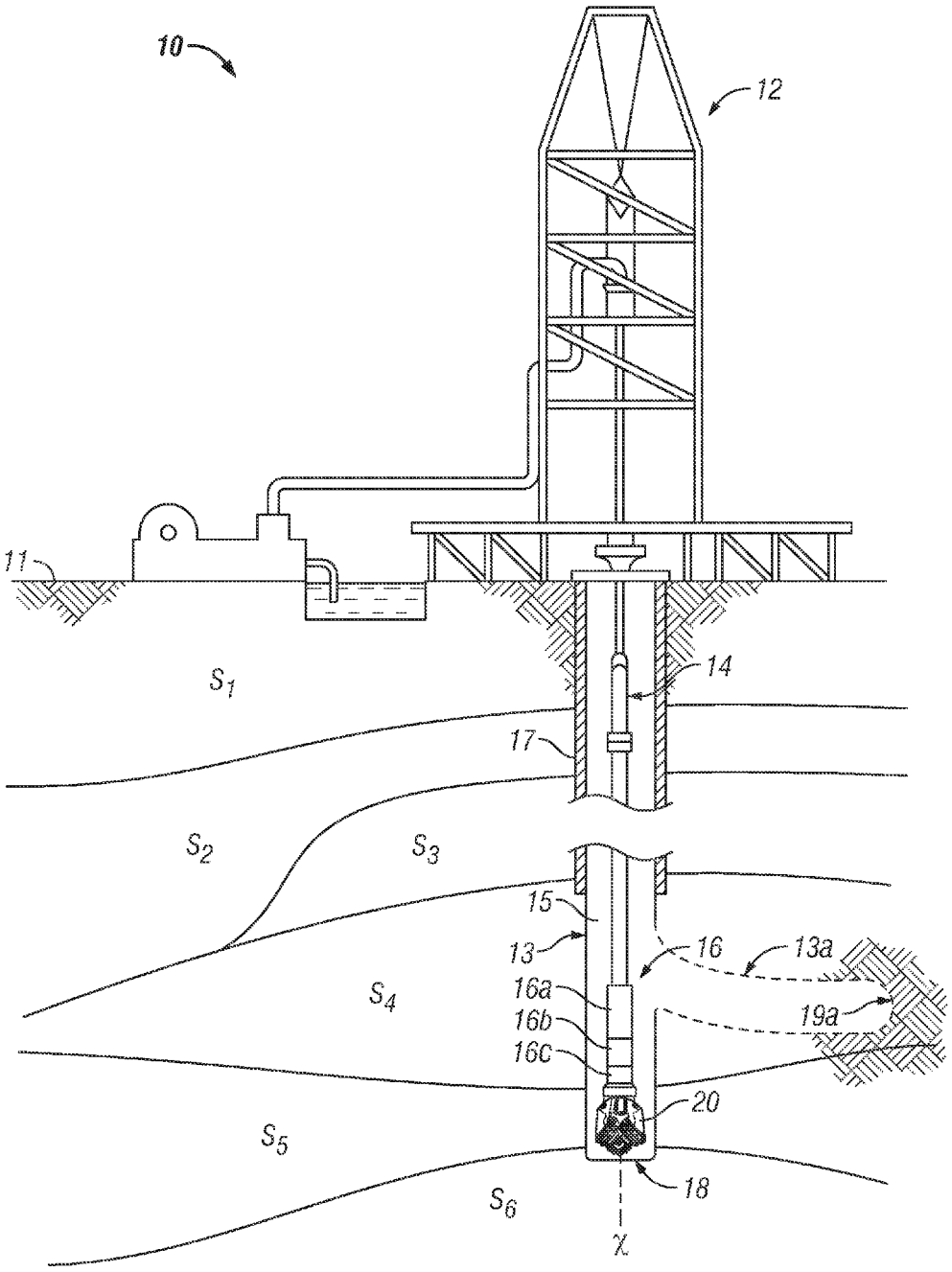
FIG. 1 illustrates a schematic drawing in section and in elevation with portions broken away showing examples of wellbores which may be formed by a roller cone drill bit incorporating teachings of the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DEFINITIONS

The following definitions are provided in order to aid those skilled in the art in understanding the detailed description of the present invention.

The term "cone assembly" as used herein includes various types and shapes of roller cone assemblies and cutter cone assemblies rotatably mounted to a support arm. Cone assemblies may also be referred to herein equivalently as "roller cones" or "cutter cones." Cone assemblies in accordance with the instant disclosure may have a generally conical exterior shape or may have a more rounded exterior shape. Cone assemblies associated with roller cone drill bits generally point inwards towards each other. For some applications, such as roller cone drill bits having only one cone assembly, the cone assembly may have an exterior shape approaching a generally spherical configuration.

The term "cutting element" as used herein refers to and includes various types of compacts, inserts, milled teeth and welded compacts satisfactory for use with roller cone drill bits. The terms "cutting structure", "cutting element" and "cutting structures" may be used interchangeably in this application to include various combinations and arrangements of cutting elements formed on or attached to one or more cone assemblies of a roller cone drill bit, including cutting blades and inserts which perform a cutting action during bit operation.

The term "bearing structure" as used herein refers to any suitable bearing, bearing system and/or supporting structure satisfactory for rotatably mounting a cone assembly on a support arm. For example, a "bearing structure" may include inner and outer races and bushing elements to form a journal bearing, a roller bearing (including, but not limited to a roller-ball-roller-roller bearing, a roller-ball-roller bearing, and a roller-ball-friction bearing) or a wide variety of solid bearings. Additionally, and without limitation, a bearing structure may include interface elements such a bushings, rollers, balls, and areas of hardened materials used for rotatably mounting a cone assembly with a support arm.

The term "roller cone drill bit" as used herein refers to any type of earth-boring drill bit having at least one support arm with a cone assembly rotatably mounted thereon. Roller cone drill bits may sometimes be described as or referred to as "rotary cone drill bits," "cutter cone drill bits", "rolling cone drill bits", or "rotary rock bits", equivalently. Roller cone drill bits typically include a bit body with at least two, often three, support arms extending therefrom and a respective cone assembly rotatably mounted on each support arm. Such drill bits may also be described as "tri-cone drill bits". However, teachings of the present disclosure may be satisfactorily used with drill bits having one support arm, two support arms or any other number of support arms and associated cone assemblies.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The standard rolling cone earth boring drill bits include a number of cutting structures which will track during operation when a tooth on one row aligns with a depression made by another tooth. Even if the tooth tracking occurs in just one row of one cone, the efficiency of formation removal during bit operation will be notably reduced. Additionally, when a cutting structure on the cones is not equally spaced, tracking can result with a similar loss in formation efficiency removal. Applicants have created roller cone drill bits and cones therefore having anti-tracking spearpoints, wherein one or more of the sets of cutting elements or teeth on the spearpoint itself are arranged in a non-symmetrical manner so as to discourage and minimize tooth tracking on the lead cone during bit operation.

Roller cone rock bits and fixed cutter bits are commonly used in the oil and gas industry for drilling wells. FIG. 1 illustrates a schematic drawing of a conventional drilling system 10 for drilling a well bore into an earth formation having a plurality of different strata, $S_1$-$S_6$. The system is shown both in elevation and in section with portions broken away showing examples of wellbores or boreholes which may be formed by roller cone drill bits incorporating teachings of the present disclosure. Various aspects of the present disclosure may be described with respect to drilling rig 12 located at well surface 11. Various types of drilling equipment such as a rotary table, mud pumps and mud tanks (not expressly shown) may be located at well surface 11. Drilling rig 12 may have various characteristics and features associated with a "land drilling rig." However, roller cone drill bits incorporating teachings of the present disclosure may also be satisfactorily used with drilling equipment located on offshore platforms, drill ships, semi-submersibles and drilling barges (not expressly shown).

Roller cone drill bit 20 as shown in FIG. 1 may be attached to the end of drill string 14 extending from well surface 11, as described generally above. Roller cone drill bits such as drill bit 20 typically form wellbores by crushing or penetrating a formation and scraping or shearing formation materials from the bottom of the wellbore using cutting elements which often produce a high concentration of fine, abrasive particles. Drill string 14 may apply weight to and simultaneously rotate roller cone drill bit 20 to form wellbore 13. The weight of associated drill string 14 (sometimes referred to as "weight on bit") will generally be applied to roller cone drill bit 20 along bit rotational axis $\chi$.

For some applications, various types of downhole motors (not expressly shown) may also be used to rotate a roller cone drill bit incorporating teachings of the present disclosure. It should be noted that the present disclosure is not limited to roller cone drill bits associated with conventional drill strings.

Drill string 14 may be formed from sections or joints of generally hollow, tubular drill pipe (not expressly shown). Drill string 14 may also include bottom hole assembly 16 formed from a wide variety of components. For example components 16*a*, 16*b* and 16*c* may be selected from the group consisting of, but not limited to, drill collars, rotary steering tools, directional drilling tools and/or a downhole drilling motor. The number of components such as drill collars and different types of components in a bottom hole assembly will depend upon anticipated downhole drilling conditions and the type of wellbore which will be formed by drill string 14 and roller cone drill bit 20.

Roller cone drill bit 20 may be attached with bottom hole assembly 16 at the end of drill string 14 opposite well surface 11. Bottom hole assembly 16 will generally have an outside diameter compatible with other portions of drill string 14. Drill string 14 and roller cone drill bit 20 may be used to form various types of wellbores and/or boreholes. For example, and without limitation, horizontal wellbore 13*a*, shown in FIG. 1 in dotted lines, may be formed using drill string 14 and roller cone drill bit 20 using directional drilling techniques. Horizontal wellbores are often formed in "chalk" formations and other types of shale formations. Interaction between roller cone drill bit 20 and chalk or shale type formations may produce a large amount of fine, highly abrasive particles and other types of downhole debris, which can further lead to an increased tendency to experience tracking problems when standard rolling cone drill bits are used.

Wellbore 13 may be defined in part by casing string 17 (such as a cement casing) extending from well surface 11 to a selected downhole location. As shown in FIG. 1, remaining portions of wellbore 13 may be described as "open hole" (that is, they have no casing). During typical operations, drilling fluid may be pumped from well surface 11 through drill string 14 to attached roller cone drill bit 20. The drilling fluid may be circulated back to well surface 11 through annulus 15 defined in part by outside diameter of drill string 14 and the inside diameter, or side wall, of wellbore 13. For some applications annulus 15 may also be defined by the outside diameter of drill string 14 and inside diameter of casing string 17.

The type of drilling fluid used to form wellbore 13 may be selected based on design characteristics associated with roller cone drill bit 20, anticipated characteristics of each downhole formation being drilled and any hydrocarbons or other fluids produced by one or more downhole formations adjacent to wellbore 13. Drilling fluids may be used to remove formation cuttings and other downhole debris (not expressly shown) from wellbore 13 to well surface 11. For example, the drilling fluids may be used to remove formation cuttings that are formed by roller cone drill bit 20 engaging end 18, sometimes referred to as the 'bottom hole', of wellbore 13. Similarly, formation cuttings may also be formed by roller cone drill bit 20 engaging end 19*a* of horizontal wellbore 13*a*. Drilling fluids may assist in forming wellbores 13 and/or 13*a* by breaking away, abrading and/or eroding adjacent portions of downhole formation strata, $S_1$-$S_6$. As a result drilling fluid surrounding roller cone drill bit 20 at end 18 of wellbore 13 may have a high concentration of fine, abrasive particles and other types of debris.

Drilling fluid is typically used for well control by maintaining desired fluid pressure equilibrium within wellbore 30. The weight or density of a drilling fluid is generally selected to prevent undesired fluid flow from an adjacent downhole formation into an associated wellbore and to prevent undesired flow of the drilling fluid from the wellbore into the adjacent downhole formation. Various additives may be used to adjust the weight or density of drilling fluids. Such additives and/or the resulting drilling fluid may sometimes be described as "drilling mud". Additives used to form drilling mud may include small, abrasive particles capable of damaging fluid seals and bearing structures of an associated roller cone drill bit. Sometimes additives (mud) in drilling fluids may accumulate on or stick to one or more surfaces of a roller cone drill bit.

Drilling fluids may also provide chemical stabilization for formation materials adjacent to a wellbore and may prevent or minimize corrosion of a drill string, bottom hole assembly and/or attached rotary drill bit. Drilling fluids may also be used to clean, cool and lubricate cutting elements, cutting structures and other components associated with roller cone drill bits 20.

Figure 2:
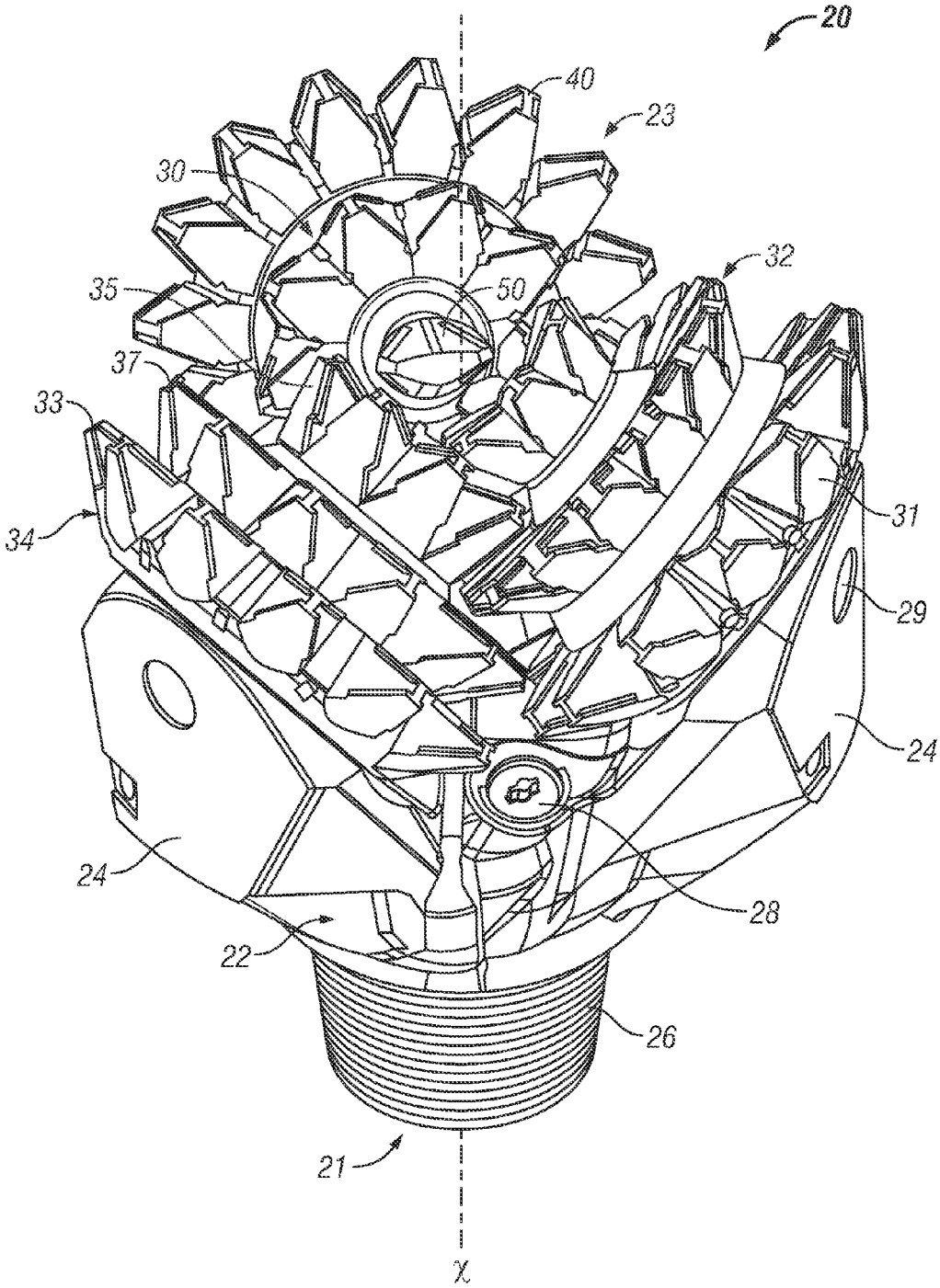
FIG. 2 illustrates an elevated perspective view of an exemplary earth-boring roller cone drill bit in accordance with the present disclosure.

Referring now to FIG. 2, the perspective view illustrates an exemplary earth-boring drill bit 20 in accordance with the present disclosure, having a bit body 22 intermediate between an upper end 21 and a spaced apart, opposite working end 23. The body of the bit also comprises three bit legs 24 comprising what is sometimes referred to as the 'shirt-tail region' depending downward toward the working end, (only two are shown). First, second and third cutter cones 30, 32 and 34 (respectively) are rotatably mounted to each of the bit legs 24, in accordance with methods generally understood in the art. It will be appreciated that while the exemplary roller cone drill bit 20 shows three cones, there may be more (e.g., four cones) or less (e.g., two cones), such bit arrangements still being within the scope of the present disclosure.

Returning to FIG. 2, each cone 30, 32 and 34 is formed of a steel shell or body, and each cone of bit 20 has two or more, preferably three, rows of teeth 40, including an outer, or gage, row 33, an inner row 35 and an intermediate row 37. However, it is acceptable for one or more of the cones 30, 32, or 34 to have different numbers of rows, such as only two rows. As shown in the Figure, and in accordance to aspects of the present disclosure, at least one of the cones will have an inner row that acts as an inner-most row of cutting blades, termed the spearpoint 50. A first conical region 36 is located between the rows 33 and 37 and a second conical region 38 is located between the rows 37 and 35, or between row 37 and spearpoint 50, and are described in more detail below with reference to FIG. 3.

The teeth 40 shown within each row 33, 35 and 37 of bit 20 may be milled or machined from the body of the individual cones 30, 32 or 34. Each tooth 40 has an apex or crest 42, and is separated from adjacent teeth in the same row by a valley 44. The base of valley 44 may be concave or U-shaped, as shown. Alternately, the base of each valley 44 may be convex if teeth 40 in a particular row are spaced far enough apart from each other. Outer rows 33 are located closest to a gage surface 31 that defines the diameter of the bit and the borehole.

Bit 20 has a threaded section 26 at its upper end for connection to a drill string (not shown), as described above. Bit 20 also has a drilling fluid passage within it that leads to a plurality of nozzles 28 for discharging drilling fluid during operation. A lubricant reservoir supplies lubricant to the bearing spaces of each of the cones 30, 32 and 34, and a pressure compensator 29 acts to equalize the lubricant pressure with the borehole fluid pressure on the exterior.

Figure 3:
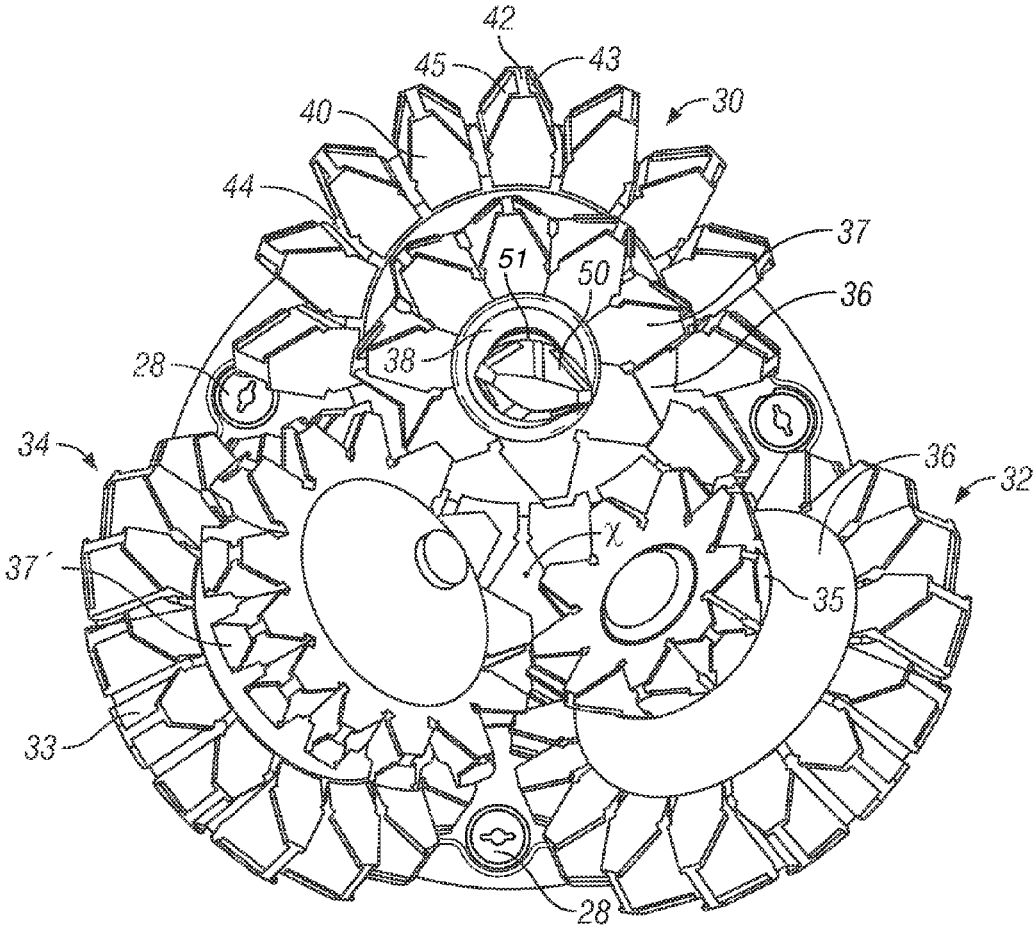
FIG. 3 illustrates a top elevational view of the roller cone drill bit of FIG. 2.

Referring to FIG. 3, exemplary bit 20 of the present invention is shown in a bottom view, illustrating the relationship of the cones 30, 32 and 34 to each other with more clarity. It should be noted that the 'cones' in the roller-cone drill bit 20, in accordance with aspects of the present disclosure, need not be perfectly conical, nor perfectly frustroconical, and may have a slightly swollen axial profile, as appropriate. First cone 30, second cone 32 and third cone 34 are typically mounted to the bottom face of bit body 22 about central bit axis $\chi$. Each of the cones 30, 32, and 34 has a plurality of teeth 40 which may be milled from the cone shell itself, or inserted as appropriate and retained by brazing, adhesives and the like, the teeth being arranged in various annular rows about the cones. While in the illustration cones 32 and 34 each have only two rows of teeth, outer row 33 and intermediate row 37', that number may vary in accordance with the present disclosure. As also shown in the layout of this figure, the intermediate row 37 of cone 30 is located farther from bit axis $\chi$ than intermediate row 37', row 37' being referred to as the closer intermediate row. Inner row 35 is also located farther from bit axis $\chi$ than spear point 50 of first cone 30.

Figure 4A:
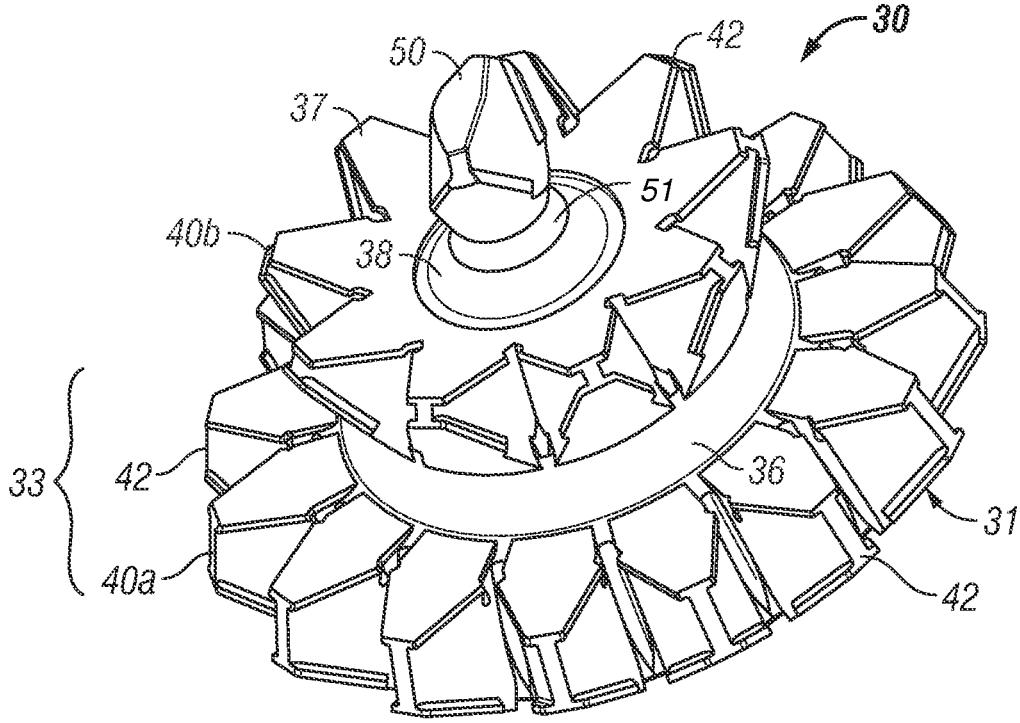
FIG. 4A illustrates an isometric top view of the first cutting cone 30 of the roller cone drill bit 20 of FIG. 2.
Figure 4B:
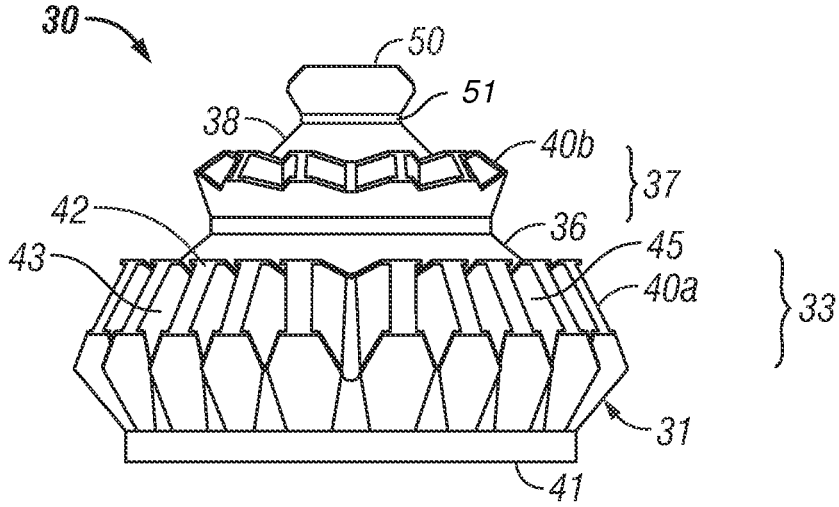
FIG. 4B illustrates a side profile view of the first cutting cone 30 of the roller cone drill bit 20 of FIG. 2.

FIGS. 4A and 4B illustrate a detailed isometric top view and a side profile view, respectively, of the first cutting cone 30 of the rolling cone drill bit 20 of FIG. 2. These figures will be discussed in combination. As shown therein, the cone includes a conical gauge surface 31 extending from the backface 41 towards the heel row 33 (also referred to as the outer row) made up of heel row teeth 40*a*. While not shown in the figures, it should be noted that the gauge surface may include additional cutting inserts or cutting elements as appropriate, such as TCI inserts and the like, having a variety of different chisel cuts or contours. As used herein, the term 'gauge row', 'outer row', or 'heel row' is meant to refer to the outermost row of teeth on a roller cone, i.e., the teeth which come nearest to the outer-most diameter of the bottom of the borehole during bit operation. The cone may also include an intermediate row 37, also having a plurality of cutting teeth, and an extreme inner row, spear point 50. As described above in FIG. 3. each of the teeth 40 on the cones comprise a tooth crest 42 defined between opposing flanks 43, 45, also referred to as the trailing and leading flanks, respectively. The teeth 40 are spaced circumferentially about the axis of cutter cone 30, defining valleys or spaces 44 between them, wherein each blade of each tooth 40 protrudes radially from the axis of rotation of the cutter cone 30. These blades also extend inward on an axis of the cutter cone 30 toward the bit axis $\chi$, converging towards an apex, or tip. The exterior of the cutter cone 30 may also include one or more smooth conical regions 36, 38 that extend inwardly toward the bit axis, or in the case of this exemplary cone, toward the spear point 50. Spear point 50 joins conical region 38 via neck region 51 and protrudes farther inward, terminating approximately at the bit axis $\chi$ when mounted on the bit legs 24 of roller cone drill bit 20. The spear point 50 is preferably machined from the shell of cutter cone 30. Additionally, and as will be described in more detail below, the spearpoint 50 in accordance with the present disclosure comprises one or more cutting blades 52 on or near the top face of the spearpoint, and which are oriented at asymmetric angles relative to each other about a central axis extending through the cone itself, the asymmetric orientation of the cutting blades 52 on the spearpoint 50 acting to reduce or eliminate bit tracking during bit use. It should be noted that typically, only one of the cutter cones (when two, three or four cutter cones are used in conjunction with the rolling cone drill bit) includes a spear point 50. Further, while not shown in this figure, as referenced previously, the cutters are mounted on legs 24 of bit 20 by means of a cantilevered shaft that forms a bearing means of the interior of the cutter, such as described and disclosed in U.S. Pat. No. 7,387,177 B2, assigned to Baker Hughes Incorporated.

Figure 5A:
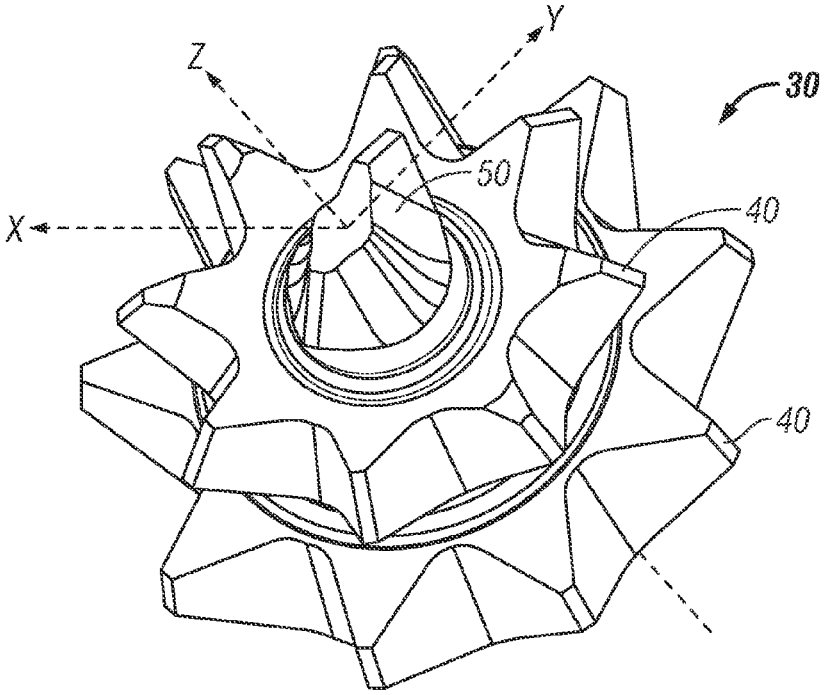
FIG. 5A illustrates a isometric elevation view of an exemplary lead cone having a spearpoint in accordance with aspects of the present disclosure.
Figure 5B:
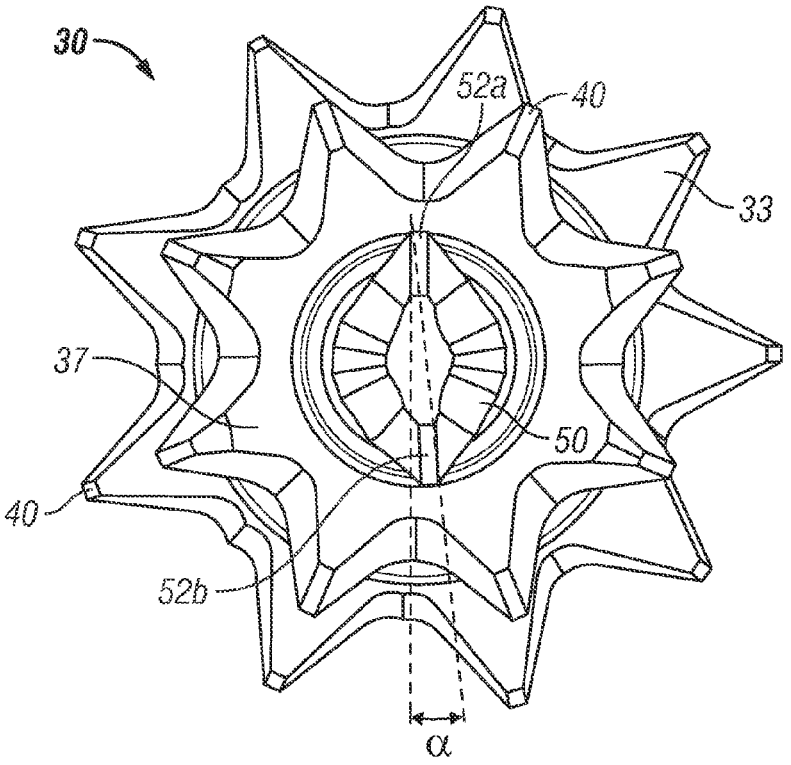
FIG. 5B illustrates a top elevational view of an exemplary spearpoint blade arrangement of the cone of FIG. 5A, in accordance with the present disclosure.
Figure 5C:
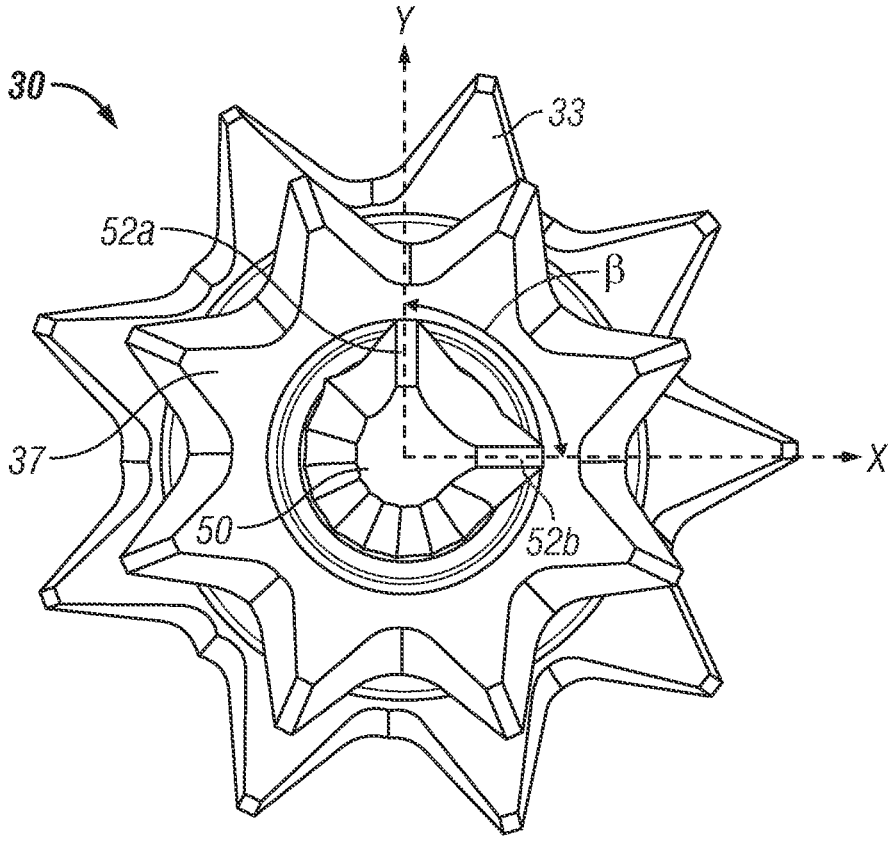
FIG. 5C a top elevational view of an alternative spearpoint blade arrangement of the cone of FIG. 5A, in accordance with the present disclosure.

In accordance with aspects of the present disclosure, and as discussed above, it has been discovered that varying the angles of orientation of the cutting teeth or blades 52 relative to each other on the spearpoint 50 of the leading cone results in a reduction and minimization of bit tracking during bit operation. Standard spearpoints found on a cone of rolling cone drill bit, if included at all, have cutting blades which are equally spaced relative to each other, i.e., the cutting blades are spaced 180° or 120° apart in the instance of a 2-tooth or 3-tooth spearpoint, respectively. Turning now to FIGS. 5A-5C, details of cutting cone 30 of the rolling cone drill bit 20 having an anti-tracking spearpoint 50 with a plurality of cutting blades (e.g., 2 or more cutting blades) arranged in an asymmetric orientation are illustrated. FIG. 5A illustrates an isometric perspective view of general cone 30, illustrating the reference axis system used in describing the anti-tracking spearpoint blade arrangements of the present disclosure having blades arranged in an asymmetric orientation with respect to each other. As shown therein, cone 30 has a central axis "Z" extending through the cone and extending outward from the center of spearpoint 50. Relative to this central axis are the perpendicularly oriented "X" and "Y" axes, which are perpendicular to each other and the central Z axis.

FIG. 5B illustrates a top view of the cone 30 of FIG. 5A, showing one spearpoint blade orientation in accordance with the present disclosure. As shown therein, cone 30 includes outer, or gauge row 33, intermediate row 37, and spearpoint 50, each of rows 33 and 37 having a plurality of cutting teeth 40. Spearpoint 50 may, in accordance with the aspect of the present disclosure shown in FIGS. 5A-5C, comprise at least two cutting blades, 52*a* and 52*b*, as shown. The cutting blades are preferably oriented relative to each other in an asymmetric manner, so as to result in an anti-tracking blade arrangement. This asymmetric orientation with respect to a two-blade spearpoint means that the cutting blades, or teeth, are angled about the central reference Z-axis an amount ranging from about 90° to about 175°, inclusive. As seen specifically in FIG. 5B, spearpoint cutting blade 52*b* can be arranged at an angle of approximately 175° relative to cutting blade 52*a*, measured with respect to the reference Y-axis. As such, there is a corresponding off-set angle, α, of blade 52*b* from the Y-axis of about 5°. In FIG. 5C, another exemplary anti-tracking orientation of spearpoint 50 having two cutting blades, or teeth, 52*a* and 52*b*, is illustrated, wherein cutting blade 52*b* is oriented at an angle β of about 90°, relative to cutting blade 52*a*. It will be understood in accordance with the present disclosure that, with reference to FIGS. 5B and 5C, when the spearpoint 50 has two cutting blades or teeth (52*a*, 52*b*), they may be arranged in an anti-tracking orientation asymmetric relative to one another at an angle ranging from about 90° to about 175°, typically ranging from about 95° to about 175°, and more typically from about 100° to about 170°, inclusive of angles of orientation within these ranges, such as an angle β of about 125°, 150°, or 167°, as appropriate and without limitation. The angle of orientation of the cutting blades on the spearpoint relative to each other, in accordance with the present disclosure, may depend on, among other factors, the hardness and type of formation that the drill bit will ultimately be used to drill through.

Figure 6A:
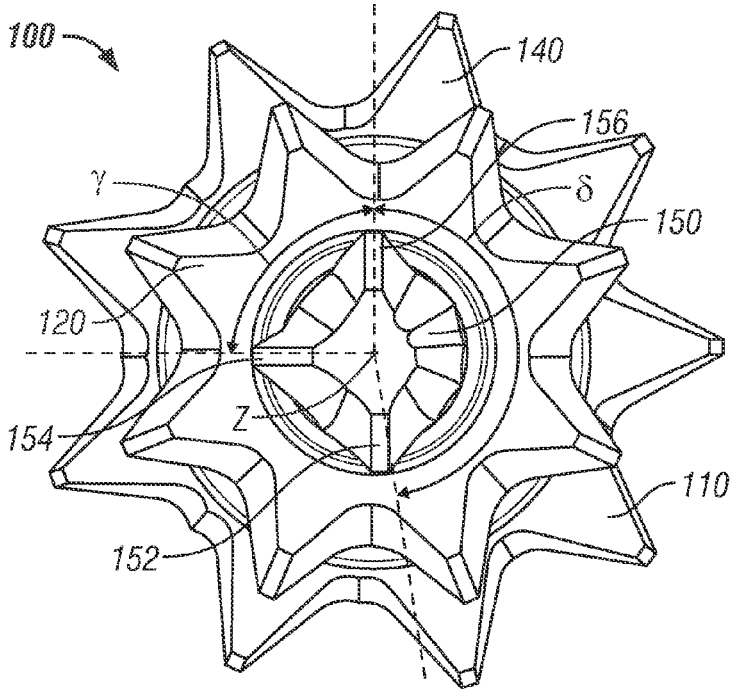
FIG. 6A illustrates a top elevational view of a further alternative spearpoint blade arrangement in accordance with the present disclosure, wherein the spearpoint has three cutting blades.
Figure 6B:
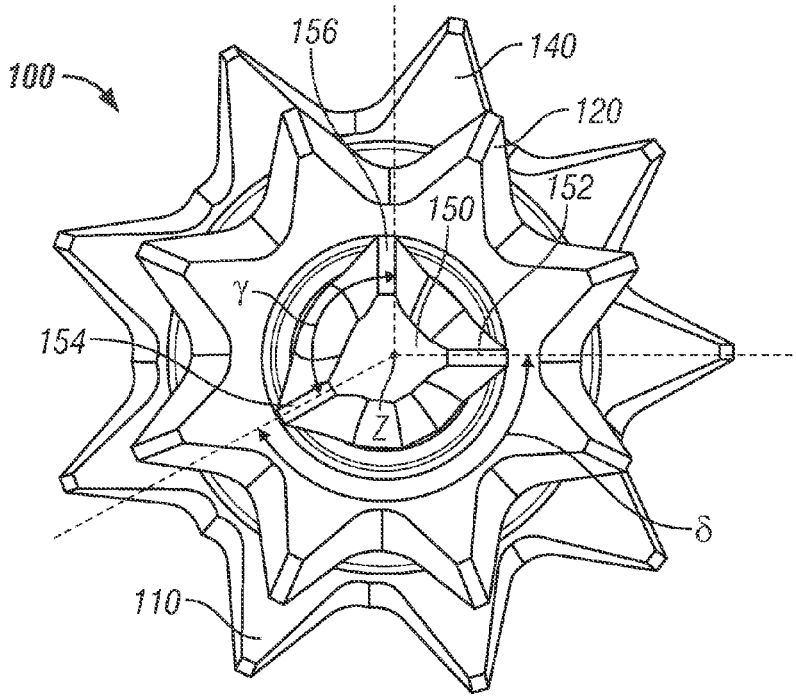
FIG. 6B illustrates a top elevational view of an another alternative spearpoint 3-blade arrangement in accordance with the present disclosure.

FIGS. 6A-6B illustrate further embodiments of the present disclosure, wherein a roller bit cone 100 for use on a rolling cone drill bit comprises an outer, gauge row 110, and intermediate row 120 (each with a plurality of cutting teeth 140 formed or affixed thereon), and a central spearpoint 150, the spearpoint having three cutting blades or teeth, 152, 154, and 156, arranged in an asymmetric, anti-tracking orientation on the top cutting face of the spearpoint. As shown in the Figures, in accordance with this aspect of the disclosure, at least one pair of teeth (e.g., cutting blade 156 and cutting blade 152) are oriented asymmetrically around the central reference Z-axis of cone 100 at an angle δ ranging between about 125° and 175°, and the remaining tooth (154) is arranged asymmetrically around the central reference Z-axis of cone 100 with respect to at least cutting tooth 152, at an angle γ ranging from about 90° to about 115°. As illustrated in FIG. 6A, cone 100 has a spearpoint 150 with three cutting blades/teeth 152, 154 and 156 on the top cutting face, wherein blades 152 and 154 are arranged asymmetrically at an angle γ of about 90°, while corresponding third blade 156 is arranged asymmetrically relative to first blade 152 at an angle δ of about 175°. A further, non-limiting cutting blade arrangement for cone 100 comprising a spearpoint with three cutting blades 152, 154, and 156 is illustrated in FIG. 6B, showing an exemplary anti-tracking blade orientation for the cutting blades on spearpoint 150 wherein blades 152 and 154 are arranged asymmetrically relative to each other at an angle γ of about 115°, while blade 152 is also arranged asymmetrically relative to the third cutting blade, 156, at an angle δ of about 125°. As set forth above, in accordance with this aspect of the disclosure, the angle δ between two of three cutting blades on the spearpoint can range from about 125° to about 175°, including angles of about 130°, about 135°, about 140°, about 145°, about 150°, about 155°, about 160°, about 165°, and about 170°, as well as angles between any two of these angles within the range, inclusive, such as an angle of about 137° or about 163°, as appropriate. Similarly, the angle g between two of three cutting blades on the spearpoint 150 can range from about 90° to about 115°, including angles of about 92°, about 94°, about 96°, about 98°, about 100°, about 102°, about 104°, about 106°, about 108°, about 110°, about 112° and about 114°, as well as angles between any two of these angles within the range, inclusive, such as an angle of about 95° or about 105°, as appropriate. The specific asymmetric cutting blade orientations illustrated herein are not meant to be limiting, as the present disclosure envisions arrangements wherein γ and δ vary within the ranges set forth above, and can be optimized depending upon the specific formation the drill bit is cutting through in order to minimize or eliminate bit tracking.

It should be realized that the embodiments shown in the Figures and specifically described are not limiting, and that the present disclosure envisions roller cone drill bits having a cone with a spearpoint with more than three cutting blades, such as four, five, six or even more blades or teeth, as appropriate. In accordance with the embodiments set forth herein, such a spearpoint having a plurality of cutting blades or teeth will have the teeth arranged asymmetrically so as to minimize or reduce bit tracking during operation. For example, if a spearpoint were to include four cutting teeth, the teeth would not be arranged symmetrically (that is, spaced 90° apart), but rather would be spaced asymmetrically relative to each other about the central Z-axis of the cone, such as at angles between about 15° and 85° and at angles between about 95° and 175°, inclusive.

While not specifically illustrated herein, the teeth and/or the blades on the spearpoints described herein may be optionally hardfaced with one or more layers of hardfacing material in order to reduce abrasion and erosive wear during operation, using any appropriate manual or automated hardfacing process known in the art, such as by an oxy-acetylene torch, and using the methods and approaches described in U.S. Pat. No. 6,253,862 and U.S. Pat. No. 7,343,990, as well as the automated methods such as described in U.S. Patent Publication No. 2010/0065337 A1 and assigned to Baker Hughes, Incorporated. Suitable hardfacing materials suitable for use in accordance with the earth-boring bits of the present disclosure include tungsten carbide particles or granules in an appropriate matrix, such as iron, cobalt, nickel, and alloys thereof. The hardfacing particles may also be cemented tungsten carbide (WC) or tungsten semicarbide ($W_2C$), cast tungsten carbide, macrocrystalline tungsten carbide, or mixtures thereof. The composition of the hardfacing is preferably uniform on the portions of the cones to which it is applied, although it may differ from tooth to tooth or cone to cone, as appropriate. Further, the hardfacing may cover the flanks, valleys, root, and edge portions of the milled teeth of the roller cone, as well as other regions as appropriate, including the spearpoint and spearpoint blades.

In further accordance with aspects of the present disclosure, the earth boring bit itself, and in particular the roller cones associated with the bit 20 and having at least one roller cone with a spearpoint having asymmetrically arranged cutting blades, may be configured such that it has a resulting IADC classification within the range of 54 to 84, or alternatively, has an IADC series classification ranging from series 1 to series 8 (as set out in FIG. 7), including series 1, series 2, series 3, series 4, series 5, series 6, series 7, or series 8, inclusive. Those skilled in the art will appreciate that the International Association of Drilling Contractors (IADC) has established a bit classification system for the identification of bits suited for particular drilling applications, as described in detail in "The IADC Roller Bit Classification System," adapted from IADC/SPE Paper 23937, presented Feb. 18-21, 1992. According to this system, each bit falls within a particular 3-digit IADC bit classification. The first digit in the IADC classification designates the formation "series" which indicates the type of cutting elements used on the roller cones of the bit as well as the hardness of the formation the bit is designed to drill. As shown for example in FIG. 7, a "series" in the range 1-3 designates a milled tooth bit, while a "series" in the range 4-8 designates a tungsten carbide insert (TCI) bit. The higher the series number used, the harder the formation the bit was designed to drill. As further shown in FIG. 7, a "series" designation of 4 designates TCI bits designed to drill softer earth formations with low compressive strength. Those skilled in the art will appreciate that such bits typically maximize the use of both conical and/or chisel inserts of large diameters and high projection combined with maximum cone offsets to achieve higher penetration rates and deep intermesh of cutting element rows to prevent bit balling in sticky formations. On the other hand, as also shown in FIG. 7, a "series" designation of 8 designates TCI bits designed to drill extremely hard and abrasive formations. Those skilled in the art will appreciate that such bits typically including more wear-resistant inserts in the outer rows of the bit to prevent loss of bit gauge and maximum numbers of hemispherical-shaped inserts in the bottomhole cutting rows to provide cutter durability and increased bit life.

The second digit in the IADC bit classification designates the formation "type" within a given series which represents a further breakdown of the formation type to be drilled by the designated bit. As further shown in FIG. 7, for each of series 4 to 8, the formation "types" are designated as 1 through 4. In this case, "1" represents the softest formation type for the series and type "4" represents the hardest formation type for the series. For example, a drill bit having the first two digits of the IADC classification as "63" would be used to drill harder formation than a drill bit with an IADC classification of "62". Additionally, as used herein, an IADC classification range indicated as "54-84" (or "54 to 84") should be understood to mean bits having an IADC classification within series 5 (type 4), series 6 (types 1 through 4), series 7 (types 1 through 4) or series 8 (types 1 through 4) or within any later-adopted IADC classification that describes TCI bits that are intended for use in medium-hard formations of low compressive strength to extremely bard and abrasive formations. The third digit of the IADC classification code relates to specific bearing design and gage protection and is, thus, omitted herein as generally extraneous with regard to the use of the bits and bit components of the instant disclosure.

Other and further embodiments utilizing one or more aspects of the inventions described above can be devised without departing from the spirit of Applicant's invention. For example, the cutting elements on the roller cones may be tungsten carbide inserts (TCI) in instead of, or in combination with, the milled tooth configurations described and illustrated herein. Further, the various methods and embodiments of the improved rolling cutter designs having varied angled spearpoints on the leading roller cone can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An earth-boring drill bit comprising:

a body with a longitudinal axis;

a plurality of bit legs depending from the body; and a plurality of roller cones attached to each of the bit legs and able to rotate with respect to the bit body, each of the cones having a plurality of rows of teeth formed thereon such that each tooth is separated from an adjacent tooth by a valley and each row is separated from an adjacent row by an annular band;

wherein one of the roller cones comprises a spear point extending outwardly along a central axis of the roller cone and comprising two or more cutting blades, the cutting blades being perpendicularly oriented at an asymmetric angle about the central axis of the roller cone relative to each other; and wherein the asymmetric angle between the cutting blades ranges from about 95° to about 175°.

2. The drill bit of claim 1, wherein the arrangement of cutting blades on the spearpoint reduces the likelihood of bit tracking during drilling operations.

3. The drill bit of claim 1, wherein the plurality of roller cones comprise three roller cones.

4. The drill bit of claim 1, further comprising a layer of hardfacing on the blades of the roller cones.

5. The drill bit of claim 1, further comprising one or more tungsten carbide inserts (TCIs) within at least one row of at least one of the roller cones.

6. A roller cone bit comprising:

a plurality of non-axially-symmetric teeth mounted on rotatable elements, one of the rotatable elements comprising a spearpoint at its apex having a plurality of cutting teeth arranged about the central axis of rotation of the rotatable element and of the spearpoint, wherein the cutting teeth which follow the same path on a cutting face have different axial orientations;

wherein a first plurality of the cutting teeth are contiguous and all have a first orientation, and a second plurality of the cutting teeth are contiguous and all have a second orientation, the first and second orientations being asymmetric relative to each other about the central axis of rotation of the rotatable element; and whereby the likelihood of bit tracking is reduced.

7. A bit for downhole rotary drilling, the bit comprising:

a plurality of roller cones, each cone being rotatably mounted on a bit body;

a plurality of cutting elements on each of the roller cones; and a spearpoint at the apex of one of the roller cones comprising a plurality of cutting elements surrounding a central axis of rotation of the cone and the spearpoint;

wherein at least one of the plurality of cutting elements on the spearpoint is a non-symmetrically oriented cutting element with respect to at least one other cutting element on the spearpoint so as to form at least two non-symmetrically oriented cutting elements having an asymmetric angle between the two cutting elements; and wherein the asymmetric angle between the at least two non-symmetrically oriented cutting elements on the spearpoint, relative to the axis of rotation of the cone on which the spearpoint is disposed, is selected to reduce a bit tracking drilling performance parameter.

8. A method of subterranean drilling, the method comprising:

rotating a rolling cone drill bit against a formation under applied weight on the bit;

drilling a central region of a borehole using only a spearpoint on one cone of the drill bit; and drilling another region of the borehole using the remaining cutting elements on the drill bit, wherein the drill bit is a drill bit of one of claim 1 or 7, and wherein the method exhibits a reduced amount of bit tracking drilling performance inhibition.

9. A rotatable cone for use with a roller cone drill bit, the cone comprising:

a plurality of cutting elements arranged on the exterior of the cone; and a spearpoint at the apex of the cone, the spearpoint comprising a plurality of cutting blades surrounding a central axis of rotation of the cone and the spearpoint;

wherein the plurality of cutting blades on the spearpoint are asymmetrically oriented with respect to the other cutting blades on the spearpoint, and wherein the plurality of cutting blades at the top face of the spearpoint include first and second cutting blades arranged asymmetrically around a central reference axis of the cone relative to each other, the cutting blades extending outwardly away from the central reference axis, the first and the second cutting blades being oriented relative to each other at a first angle.

10. The rotatable cone of claim 9, wherein the spearpoint further comprises a third blade, the third blade being arranged asymmetrically around the central reference axis at a second angle, the first and second angles being unequal.

11. The rotatable cone of claim 9, wherein the first angle ranges between about 125° and about 175°, and the second angle ranges from about 90° to about 115°.

12. The rotatable cone of claim 9, wherein the first angle is about 125° and the second angle is about 115°.

* * * * *